United States Patent [19]

Allen

[11] Patent Number: 4,853,986

[45] Date of Patent: Aug. 8, 1989

[54] WATER LEVEL CONTROL

[75] Inventor: D. Mason Allen, Altamonte Springs, Fla.

[73] Assignee: The Awareness Marketing Corporation, Jacksonville, Fla.

[21] Appl. No.: 815,647

[22] Filed: Jan. 2, 1986

[51] Int. Cl.[4] ..... E04H 3/18

[52] U.S. Cl. ..... 4/508; 137/438; 239/576

[58] Field of Search ..... 4/508, 411, 412, 403, 4/395, 394; 137/438, 429, 451; 239/576

[56] References Cited

U.S. PATENT DOCUMENTS

| | | | |
|---|---|---|---|
| 605,989 | 6/1898 | Bean | 4/412 |
| 1,062,537 | 5/1913 | Culbertson | 137/438 X |
| 2,149,584 | 3/1939 | Davis | 239/576 X |
| 2,758,313 | 8/1956 | Hagen | 4/412 X |
| 2,785,016 | 3/1957 | Vollertzen et al. | 239/576 X |
| 2,804,344 | 8/1957 | Price | 239/576 |
| 3,181,558 | 5/1965 | Straub | 137/438 |
| 3,438,064 | 4/1969 | Taien | 4/403 |

*Primary Examiner*—Henry J. Recla
*Attorney, Agent, or Firm*—William M. Hobby, III

[57] ABSTRACT

A water level control apparatus for controlling the water level in swimming pools, and the like, has a water nozzle having a hose connector on one end and a water outlet on the other end. A valve is formed in the water nozzle for blocking the flow of water therethrough until the nozzle is bent by a predetermined distance. The water nozzle forms a portion of the valve formed therein. A weighted float is connected to the water nozzle and has a predetermined mass for applying a gravitational force to the water nozzle sufficient to actuate the valve formed in the nozzle to allow the flow of water therethrough. The weighted float also has a predetermined floatation to reduce the gravitational force applied to the nozzle when immersed in water to a predetermined level to thereby close the valve and stop the flow of water therethrough. The weighted float can be connected to the water nozzle with a flexible cord.

9 Claims, 1 Drawing Sheet

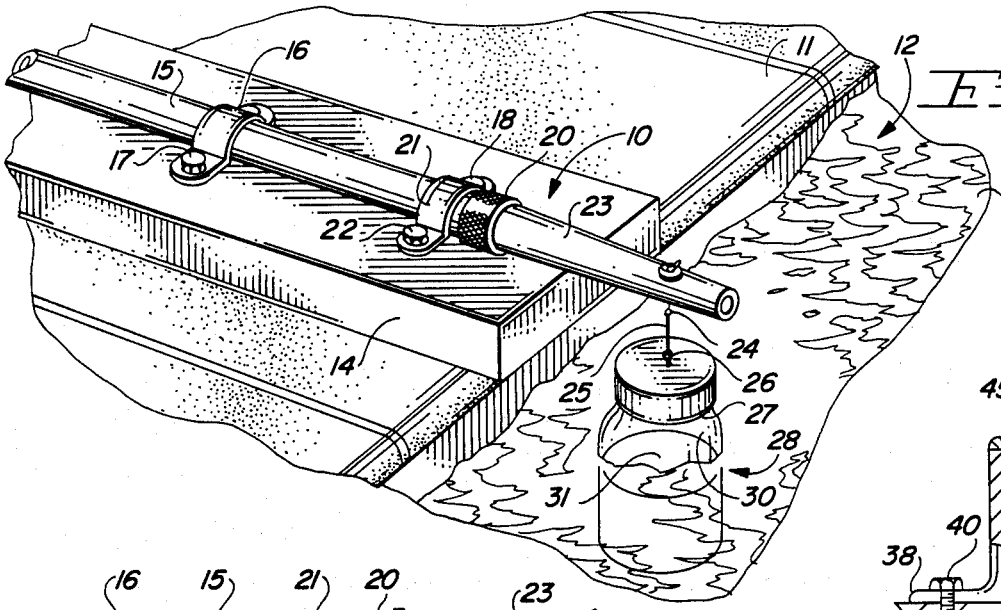
FIG. 1
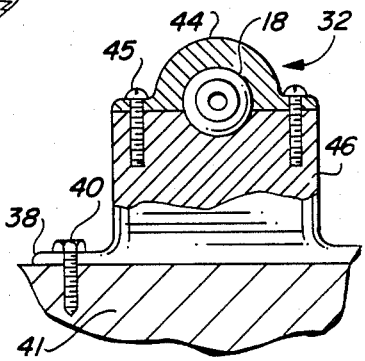
FIG. 3A
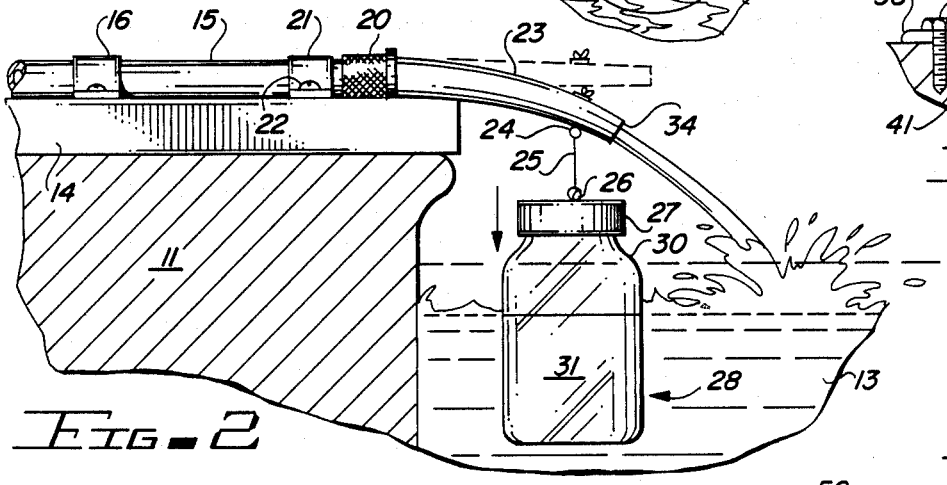
FIG. 2
FIG. 4
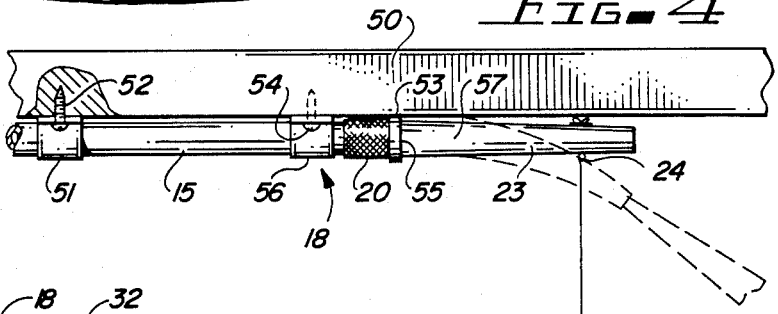
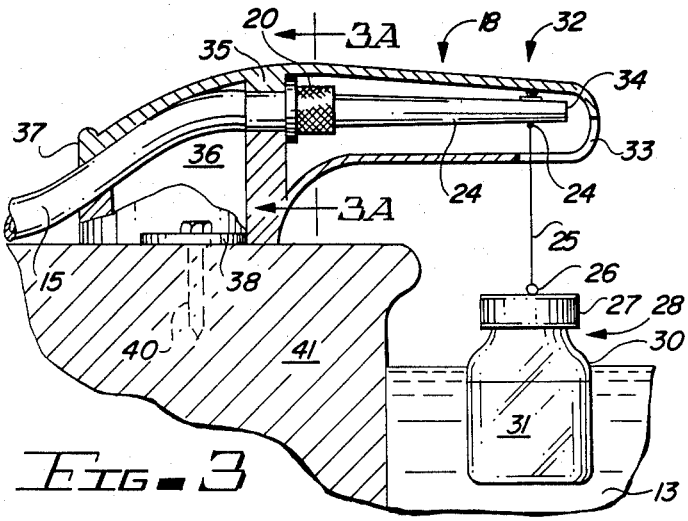
FIG. 3
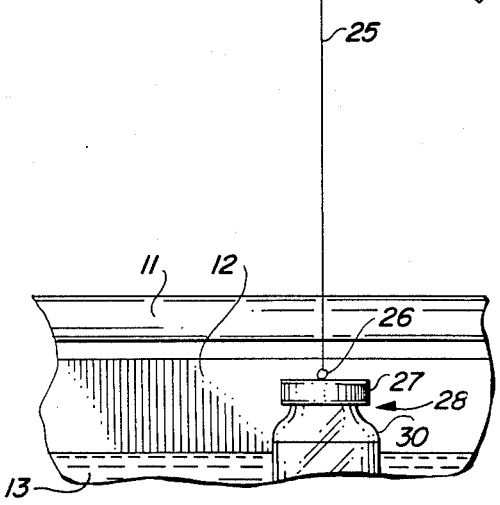

WATER LEVEL CONTROL

BACKGROUND OF THE INVENTION

The present invention relates to water level controls and especially to water controls for swimming pools, and the like.

In the past, it has been common to fill swimming pools, fish ponds, and the like and to thereafter add water from a garden hose whenever the water level has dropped a noticeable distance. Pools, on the other hand, have been provided automated clorinators and circulating filters, as well as automatic cleaning systems to maintain the pool in condition for long periods of time without owner maintenance. This is especially desirable in conditions where an absentee owner may be renting property or may be away for long periods of time. It also becomes desirable to have a system for automatically maintaining the level of water in a swimming pool, and there have been a wide variety of patents and systems teaching ways to maintain this water level on a continuous basis. Frequently, these prior Systems have used float control valves commonly used in bathrooms for controlling the flow of water into the swimming pool. Such systems can be seen in U.S. Pat. No. 4,342,125 for a Water Level Control for Swimming Pools; U.S. Pat. No. 3,908,206 for an Automatic Water Level Keeper for Swimming Pools; and in U.S. Pat. No. 3,895,402 for a Remotely Located Apparatus for Maintaining the Water Level within a Swimming Pool. Float control valves for maintaining the water level in swimming pools can also be seen in U.S. Pat. No. 3,837,015 for a Water Level Control for Swimming Pools; U.S. Pat. No. 2,679,260 for a Liquid Control; and in U.S. Pat. No. 3,997,925 for an Apparatus to Control the Water Level in a Swimming Pool. U.S. Pat. No. 4,014,052 shows an Apparatus for Maintaining a Predetermined Liquid Level as does U.S. Pat. No. 3,139,628 for an Automatic Refill System for Swimming Pools, which system is formed into the pool wall. More recently electronic controls have been used, such as that shown in U.S. Pat. No. 4,445,238 for a Swimming Pool Water Level Control Apparatus, which electronically controls the level of the water.

These prior systems tend to be unduly complex or expensive and the larger float systems can be unsightly when attached to the swimming pool. The present invention, on the other hand., provides a greatly simplified swimming pool water level control apparatus without the use of electronics and which can be easily attached to existing pools for maintaining the water level in the pools. The system can also provide drinking water for a swimmer in the pool, if the swimmer becomes thirsty.

SUMMARY OF THE INVENTION

The present invention relates to a water level control apparatus for controlling the water level of swimming pools and the like having a water nozzle with a valve formed therein. The water nozzle has a hose connector connected to one end thereof and a water outlet on the other end thereof, and may be attached to the edge of a swimming pool, such as to a diving board or to a specially formed bracket for supporting a water nozzle along the edge of a swimming pool. The valve is formed in the water nozzle and uses a portion of the water nozzle to form a part of the valve for blocking the flow of water through the nozzle until the nozzle is bent a predetermined distance. A weighted float is connected to the water nozzle, such as by a flexible cord or chain and has a predetermined mass to apply gravitational force to the water nozzle sufficient to actuate the valve to allow the flow of water through the nozzle. The weighted float also has a predetermined floatation to reduce the gravitational force applied to the nozzle when the weighted float is immersed in water a predetermined distance to thereby close the valve and stop the flow of water through the nozzle, so that the water level control can monitor the flow of water through a valve until the water level in the body of water rises to a predetermined level on the weighted float. The valve includes a valve element which may be in a generally disk shape closing against a valve seat formed in the nozzle. The valve element can have a elongated protruding rod protruding through the valve seat into the exit portion of the nozzle, so that bending the nozzle bends the rod to tilt the disk valve element on the valve seat to allow the flow of water therethrough.

BRIEF DESCRIPTION OF THE DRAWINGS

Other objects, features and advantages of the present invention will be apparent from the written description and the drawings in which:

FIG. 1 is a perspective view of a water level control apparatus in accordance with the present invention mounted on the side of a swimming pool;

FIG. 2 is a sectional view taken through the side of the swimming pool of FIG. 1 adjacent to the water level control apparatus;

FIG. 3 is a sectional view of an alternate embodiment taken through the side of the swimming pool and through the water level control apparatus;

FIG. 3A is a sectional view taken on the line 3-A—3-A of FIG. 3; and FIG. 4 is a partial side elevation of a water level control apparatus attached to a diving board of a swimming pool.

DETAILED DESCRIPTION OF THE PREFERRED EMBODIMENTS

Referring to the drawings, a water level control apparatus 10 is shown mounting to the pool deck 11 of a swimming pool 12 partially filled with water 13. The water level control 10 is mounted to a support member 14 resting on or attached to the deck 11 and has a hose, such as a garden hose 15, supported by brackets 16 attached with threaded bolts 17 to the support block 14. The hose 15 is threaded to the nozzle 18 threaded coupling 20. The outlet nozzle 18 and hose 15 connected is attached behind nozzle 18 fitting with a bracket 21 by bolts 22 to the block 14 and rigidly holds the nozzle 18 in place. The nozzle 18 has a flexible or bendable portion 23 which may be made of a reinforced rubber or polymer and has an eyelet 24 attached therethrough. A flexible polymer cord 25 is connected to the eyelet 24 and to an eyelet 26 on the cap 27 of a weighted float 28. The weighted float 28 may be a hollow container 30 partially filled with a liquid, such as water 31, to a predetermined level therein, and may have the threaded cap 27 threaded tightly thereupon. Thus the weighted float 28 is weighted by the weight of the container 27 as well as by the liquid 31 therein filling the container to a predetermined level. The hollow space above the liquid, provides floatation so that after the water rises to a predetermined level it then acts as a float to reduce the gravitational pull against the flexible nozzle portion 23. When the water level is low enough, as shown in FIG. 2, the weighted float 28 bends the bendable portion 23 of the nozzle 10, as shown in FIG. 2, to allow water to flow through the nozzle into the pool. But as the water level of the water 13 rises, the float portion such as the air above the liquid 31 in the container 30 begins to float the weighted float 28 to allow the flexible portion of the nozzle 23 to straighten and thereby cut off the flow of water therethrough. Different levels can be adjusted by varying the length of the flexible cord 25. Varying the amount of the liquid 31 in the container 30 will vary the relationship between the floatation and the mass supported on the nozzle 18. The liquid is shown as water, but can of course be any material desired such as sand, and the float can be made as one solid unit having a floatation portion and solid weighted portion, if desired.

FIG. 3 shows the nozzle valve 18 mounted in a special support base 32 surrounding the nozzle 18 including the flexible portion 23. The support bracket 32 has an opening 33 in the end theroef to allow for the flow of water out the end 34 of the nozzle 18. The nozzle 18 is supported in a support opening 35 which allows the threaded coupling 20 to protrude into an opening 36 of the support bracket 32 and out an opening 37 therefrom so that the hose 15 can be run through the opening 37 and attached to the threaded nozzle attachment 20. The nozzle bracket 32 also has flanges 38 for driving bolts 40 therethrough into the pool side concrete 41. This embodiment has the cord 25 supporting the weight 28 having the cap 27 with an eyelet 26 attached thereto and the container 30 having a liquid 31 therein protruding into the water 13. The flexible cord is also connected to the eyelet 24 as shown in FIGS. 1 and 2.

FIG. 3A shows the support bracket 32 having a top hold down portion 42 supported with threaded fasteners 45 bolting onto the nozzle 18 and into a bottom portion 46 of the bracket 32 which in turn is bolted with the fasteners 40 through the flanges 38 into the pool decks 41.

FIG. 4 shows the nozzle 18 connected to the hose 15 at the nozzle threaded coupling 20 and supported to a pool diving board 50 through a bracket 51 fastened with screws 52 and with a second bracket 53 fastened with threaded fasteners 54. This embodiment has the flexible nozzle portion 23 having the eyelet 24 connected to a flexible cord 25 and the cord connected to the eyelet 26 of the cap 27 on the container 30 of the weighted float 28 in the pool water 13 adjacent the coping of the swimming pool 12. A ledge 55 is formed in the nozzle 18 and has a disk shaped valve element (FIG. 3A) forced against the annular ledge 55 in the valve by the water pressur from the water in the hose 15. The disk shaped valve element 56 may have a rubber surface to give a complete seal against the annular valve seat 55. A small elongated rod 57 (FIG. 3A) is attached to the center of the disk shaped element 56 and extends to the valve seat 55 into the flexible portion of the nozzle 23, bending the nozzle flexible portion 23. Thus bending or tilting the rod 56 tilts the disk shaped valve element 56 to allow water to pass thereby. When the nozzle flexible portion 23 is straightened back up it straightens the rod 57 and the water pressure in the hose 15 seals the disk shaped element 56 against the valve seat 55 closing off the flow of water.

It should be clear at this point that a water level control has been provided in which a combined water nozzle and valve element 18 has the valve element formed therein. The nozzle has the valve seat 55 formed as an annular ledge and having a disk shaped valve element pressed thereagainst to seal off the flow of water through the valve seat 55. An elongated rod 57 is attached to the center of the disk shaped valve element 56 and is tilted by the bending of the flexible nozzle portion 23 to tilt the valve element 56 to allow the passage of water thereby. The nozzle flexible portion 23 supports a float weight 28 thereupon with a flexible cord 25 so that the weighted float 28 will pull the flexible nozzle portion 23 to bend it to tilt the rods 57 to open the valve to allow water to flow into the pool, by virtue of the mass of the weighted float 28. However, once the water level of the water 13 rises over a portion of the weighted float 28, the floatation part tends to lessen the mass of the float weight 28 thereby allowing the flexible hose portion 23 to straighten the rod 27. The water pressure in the hose 15 pushing against the disk valve element 56 closes off the flow of water, so that the water level is controlled by the weighted float 28 to actuate the combined nozzle and valve 18. The nozzle and valve 18 can be attached as shown in FIG. 3 or as shown in FIGS. 1 and 2 or as shown in FIG. 4. An individual swimmer can swim over to the valve element, grasp the flexible portion 23 and bend the nozzle portion to thereby cause the flow of water through the nozzle end 34 for the swimmer to get a drink of water while swimming in the pool.

Thus it should be clear that the present invention is not to be considered as limited to the forms shown which are to be considered illustrative rather than restrictive.

I claim:

1. A water level control apparatus for controlling the water level of a swimming pool, comprising in combination:

a water nozzle having a hose connector on one end thereof and a water outlet from the other end thereof;

a valve formed in said water nozzle for blocking the flow of water therethrough until said nozzle is bent by a predetermined distance;

a nozzle support means for supporting said nozzle adjacent a body of water, said water nozzle means comprising a water nozzle support encasing said water nozzle and having an opening in the end portion thereof for allowing the escape of water therethrough; and a weighted float connected to said water nozzle and having a predetermined mass to apply a gravitational force to said water nozzle sufficient to actuate said valve to allow the flow of water therethrough and having a predetermined flotation to reduce the gravitational force applied to said nozzle when said weighted float is immersed in water to a predetermined level to thereby close said valve and stop the flow of water therethrough, said weighted float being connected to said water nozzle with an adjustable, elongated, flexible cord, the length of which is adjustable to determine a predetermined level of water in a body of water whereby said water level control apparatus can monitor the flow of water through said valve until the water level in said body of water rises to a predetermined level on said weighted float.

2. A water level control apparatus in accordance with claim 1 in which said weighted float is a partially filled hollow container.

3. A water level control apparatus in accordance with claim 2 in which said weighted float is a partially empty container and has a threaded cap thereon, and said threaded cap has an eyelet formed thereof for attaching said flexible cord thereto.

4. A water level control apparatus in accordance with claim 3 in which said hollow container is a transparent polymer container partially filled with a mass.

5. A water level control apparatus in accordance with claim 4 in which said water nozzle has a reinforced rubber nozzle portion, bendable relative to a rigid support nozzle portion.

6. A water level control apparatus in accordance with claim 1 in which said water nozzle support is attached to a pool deck with threaded fasteners.

7. A water level control apparatus in accordance with claim 6 in which said water nozzle support has two portions, one of which is attached to the other to clamp onto said water nozzle for supporting said water nozzle therein.

8. A water level control apparatus in accordance with claim 7 in which said water nozzle support has an opening for a water hose to pass thereinto for attaching to said water nozzle hose connector.

9. A water level control apparatus in accordance with claim 1 in which said water nozzle is connected to a hose which has attaching brackets for attaching to a diving board adjacent a swimming pool.

* * * * *